US007336795B2

(12) United States Patent
Miyata et al.

(10) Patent No.: US 7,336,795 B2
(45) Date of Patent: Feb. 26, 2008

(54) CARD SOUND DEVICE AND ELECTRONIC APPARATUS HAVING SAME

(75) Inventors: Kazuhiko Miyata, Habikino (JP); Hidetaka Mizumaki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 227 days.

(21) Appl. No.: 10/504,127

(22) PCT Filed: Feb. 12, 2003

(86) PCT No.: PCT/JP03/01449

§ 371 (c)(1),
(2), (4) Date: Aug. 11, 2004

(87) PCT Pub. No.: WO03/069950

PCT Pub. Date: Aug. 21, 2003

(65) Prior Publication Data

US 2005/0105747 A1 May 19, 2005

(30) Foreign Application Priority Data

Feb. 15, 2002 (JP) ..... 2002-037744

(51) Int. Cl.
*H04R 25/00* (2006.01)

(52) U.S. Cl. ..... 381/152; 381/151; 381/388

(58) Field of Classification Search ..... 381/151, 381/152, 386, 396, 190, 191, 306, 333, 388, 381/423, 431; 40/124.01; 361/681–683, 361/686

See application file for complete search history.

(56) References Cited

U.S. PATENT DOCUMENTS 5,828,768 A * 10/1998 Eatwell et al. ..... 381/333
6,169,809 B1 * 1/2001 Azima et al. ..... 381/152
6,359,991 B1 * 3/2002 Azima et al. ..... 381/152
7,174,025 B2 * 2/2007 Azima et al. ..... 381/152

FOREIGN PATENT DOCUMENTS

| | | |
|---|---|---|
| JP | 60-58783 | 4/1985 |
| JP | 63-159443 | 10/1988 |
| JP | 63-299996 | 12/1988 |
| JP | 1-142993 | 9/1989 |
| JP | 5-94898 | 12/1993 |
| JP | 6-160830 | 6/1994 |
| JP | 10-145291 | 5/1998 |
| JP | 3069057 U | 3/2000 |
| JP | 3073075 U | 8/2000 |
| JP | 2001-93450 | 4/2001 |
| JP | 2001-154218 | 6/2001 |
| JP | 2001-343915 | 12/2001 |

* cited by examiner

*Primary Examiner*—Huyen Le
(74) *Attorney, Agent, or Firm*—Nixon & Vanderhye P.C.

(57) ABSTRACT

A card-type sound apparatus has, on a card-shaped substrate, a combination of a sound signal input portion to which a sound signal is input from outside and a sound generation portion that generates sound according to the sound signal input to the sound signal input portion, or a combination of a sound collection portion that collects sound from outside and converts the sound into an electric signal and a sound signal output portion that outputs to outside the electric signal obtained from the sound collection portion, or both of these combinations. The sound generation portion generates sound by making the card-shaped substrate itself vibrate according to the sound signal input to the sound signal input portion. The sound collection portion collects sound by converting the vibration of the card-shaped substrate itself into an electric signal.

5 Claims, 11 Drawing Sheets

CARD SOUND DEVICE AND ELECTRONIC APPARATUS HAVING SAME

This application is the US national phase of international application PCT/JP03/01449 filed 12 Feb. 2003 which designated the U.S. and claims benefit of JP 2002-037744, dated 15 Feb. 2002, the entire content of which is hereby incorporated by reference.

TECHNICAL FIELD

The present invention relates to a card-type sound apparatus composed of a portable card-shaped substrate.

BACKGROUND ART

In recent years, portable apparatuses capable of taking in images from an external apparatus and displaying them have been becoming commercially available.

However, in the current stage of their development, for such portable apparatuses with image display capability to have loudspeaker and microphone capabilities, they need to be provided separately with an apparatus with image display capability and an apparatus with sound capability. This makes it difficult to realize such portable apparatuses in card size. It is possible to realize apparatuses with display capability alone in card size, but such apparatuses, without loudspeaker or microphone capability, do not permit their users to enjoy sound accompanying images.

DISCLOSURE OF THE INVENTION

An object of the present invention is to provide a card-type sound apparatus that permits its user to readily enjoy sound.

To achieve the above object, according to the present invention, a card-type sound apparatus is provided with a combination of a sound signal input portion to which a sound signal is input from outside and a sound generation portion that generates sound according to the sound signal input to the sound signal input portion, or a combination of a sound collection portion that collects sound from outside and converts the sound into an electric signal and a sound signal output portion that outputs to outside the electric signal obtained from the sound collection portion, or both of these combination. Here, the sound signal input portion, the sound generation portion, the sound collection portion, and the sound signal output portion, whichever is present, are all provided on a card-shaped substrate.

In this way, a card-type sound apparatus is provided with loudspeaker capability, or microphone capability, or both, and thus permits its user to readily enjoy sound.

Sound may be generated or collected by letting the body of the card-type sound apparatus vibrate. For example, the sound generation portion is composed of a vibrator portion and an exciter portion that makes the vibrator portion vibrate according to the sound signal input to the sound signal input portion, the sound collection portion is composed of the vibrator portion and a pickup portion that converts the vibration of the vibrator portion into an electric signal and feeds the electric signal to the sound signal output portion, and the card-shaped substrate serves as the vibrator.

In this way, by achieving sound generation or sound collection by letting the card-shaped substrate itself, which serves as the body of the card-type sound apparatus, vibrate, it is possible to make the card-type sound apparatus slim and compact easily.

The card-shaped substrate may form a display portion. In this case, the vibrator portion may be arranged parallel to the surface of the card-shaped substrate on which display is performed. With this structure, display and sound generation or sound collection are performed on the same surface.

In a case where the card-shaped substrate forms a display portion, the card-shaped substrate may serve also as the vibrator. In this case, the exciter portion or the pickup portion may be provided in a frame portion of the card-shaped substrate in which no display is performed. In a case where the card-shaped substrate is of a type that does not use one surface thereof for display, the exciter portion and the pickup portion may be provided on the surface of the card-shaped substrate which is not used for display.

With the former structure, the vibrator portion is not located on the front surface of the display portion. This helps enhance display quality and make the card-type sound apparatus slimmer. With the latter structure, it is possible to give the exciter portion and the pickup portion larger areas and thereby obtain higher sound-generation and sound-collection gains without degrading display quality.

As the exciter portion, a plurality of exciter portions may be provided, and, as the pickup portion, a plurality of pickup portions may be provided. With this structure, it is possible to obtain increased sound-generation and sound-collection gains, achieve stereophonic sound reproduction, and realize directivity. The undesirable effects of vibration on the display portion are reduced through interference inside the display portion, and this helps improve or maintain display quality even if the display portion employs a movable material such as liquid crystal.

The exciter portion may function also as the pickup portion. This makes it easy to realize both loudspeaker and microphone capabilities even in a case where a sufficiently large space cannot be secured for the exciter portion or the pickup portion.

In a case where both a combination of the sound signal input portion and the sound generation portion and a combination of the sound collection portion and the sound signal output portion are provided, these two combinations may be used alternatively so that one of them is used at a given time. With this structure, the card-type sound apparatus can be used as if a transceiver.

In a case where both a combination of the sound signal input portion and the sound generation portion and a combination of the sound collection portion and the sound signal output portion are provided, there may be further provided an inverted-phase signal generator portion that inverts the phase of the sound signal input to the sound signal input portion to produce an inverted-phase signal and a mixer portion that mixes the electric signal obtained from the sound collection portion with the inverted-phase signal. In this case, the signal obtained from the mixer portion is fed to the sound signal output portion. With this structure, the card-type sound apparatus can be used as if a telephone.

In a case where a display portion is provided, display operation may be interlocked with sound generating operation or sound collecting operation. With this structure, it is not necessary to provide functions for controlling the starting and stopping of a display-related circuit block and a sound-related circuit block separately. This helps simplify the circuit configuration, prevent failure to deactivate the operation of only one of the circuit blocks, and reduce electric power consumption.

The exciter portion may be composed of an expandable plate that expands and contracts according to an electric signal fed thereto, and may be provided directly on the vibrator portion. With this structure, it is possible to make the card-type sound apparatus slimmer.

The exciter portion may be composed of an expandable plate that expands and contracts according to an electric signal fed thereto and a vibration transmission plate that holds the expandable plate, with the vibration transmission plate supported partially by making direct contact with the vibrator portion and partially by lying on a soft material, so soft as not to hamper vibration, that fills the gap between the vibration transmission plate and the vibrator portion. With this structure, it is possible to obtain a higher excitation gain.

There may be additionally provided a display-related circuit block which comprises an image signal input portion to which an image signal is input from outside and a display driver portion that drives the display portion according to the image signal input to the image signal input portion. In this case, part or the whole of the display-related circuit block is formed directly on a thin-film substrate on which the circuit elements of the display portion are formed. Alternatively, in addition to the part or whole of the display-related circuit block, part or the whole of a sound-related circuit block that handles a sound signal may be formed directly on the thin-film substrate on which the circuit elements of the display portion are formed. With these structures, it is possible to make the card-type sound apparatus still slimmer and more compact.

The thin-film substrate on which the circuit elements of the display portion are formed may be a thin film of polycrystalline silicon. The display portion may be provided on both surfaces. The display portion may be provided on one surface, with an operation portion provided on another surface.

The display portion may achieve display, for example, by using liquid crystal, or by using an EL device, or by controlling the states of movable pixel portions individually between a state in which they reflect incident light and a state in which they scatter incident light, or by FED (field emission display). Adopting any of these display types helps make the card-type sound apparatus slimmer.

In an electronic appliance of any type that handles images and sound, one of the card-type sound apparatuses structured as described above may be provided as a means for inputting or outputting sound or as a means for outputting images. This permits the user of such an electronic appliance to readily enjoy sound or images.

BEST MODE FOR CARRYING OUT THE INVENTION

Figure 1:
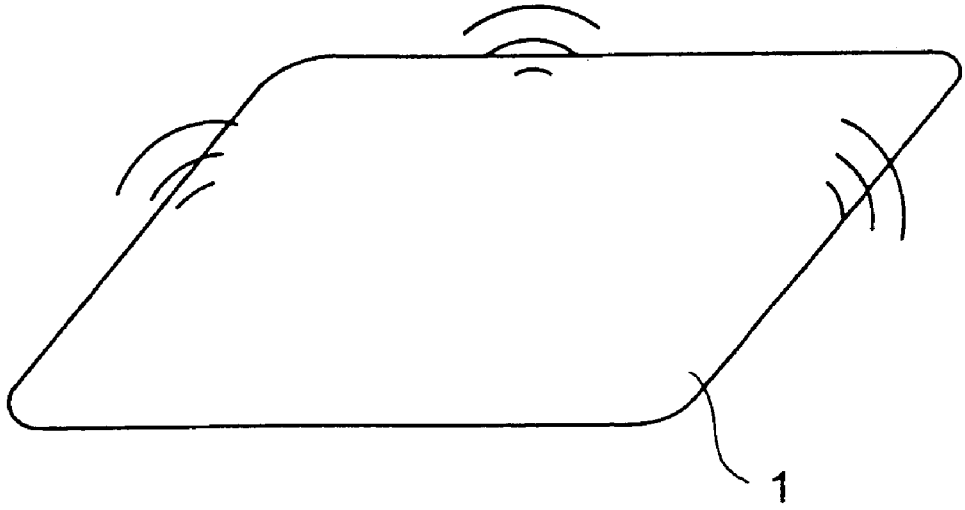
FIG. 1 is a conceptual diagram of a card-type sound apparatus embodying the invention.

Hereinafter, embodiments of the present invention will be described with reference to the drawings. A card-type sound apparatus embodying the invention, as shown in FIG. 1, which is a conceptual diagram thereof, is composed of a card-shaped substrate 1 that has a size roughly equal to the size of a common credit card or business card and that thus is quite easily portable. This card-type sound apparatus realizes loudspeaker and microphone capabilities by letting the card-shaped substrate 1 itself vibrate.

Figure 2:
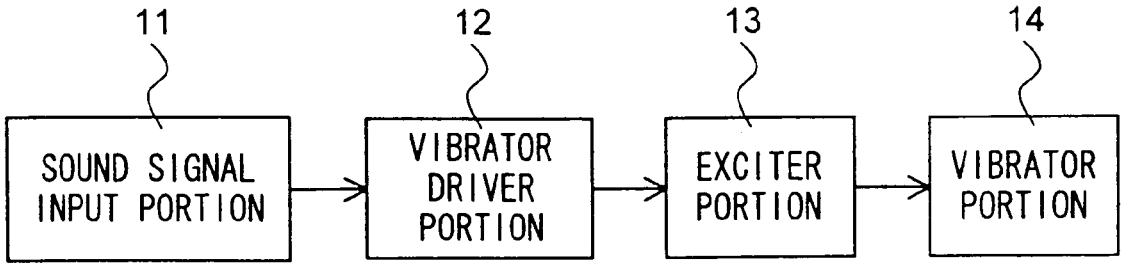
FIG. 2 is a block diagram of the card-type sound apparatus of a first embodiment of the invention.

FIG. 2 is a block diagram of the card-type sound apparatus of a first embodiment of the invention. To a sound signal input portion 11, a sound signal is input from an external apparatus of any type. A vibrator driver portion 12 drives an exciter portion 13 with the sound signal input to the sound signal input portion 11. Here, if the output signal of the sound signal input portion 11 has a sufficiently high output level to drive the exciter portion 13 and is in the form of nothing but a sound signal, it is not absolutely necessary to provide the vibrator driver portion 12. The exciter portion 13 makes a vibrator portion 14 vibrate according to the electric signal with which the exciter portion 13 is driven by the vibrator driver portion 12.

Used as the exciter portion 13 is a piezoelectric element formed of a crystal of quartz or Rochelle salt or a thin ceramic plate. The exciter portion 13 is provided on a card-shaped substrate 1, and this card-shaped substrate 1 serves as the vibrator portion 14. Thus, as shown in the conceptual diagram of FIG. 1, sound is generated by letting the card-shaped substrate 1 itself vibrate.

Figure 3:
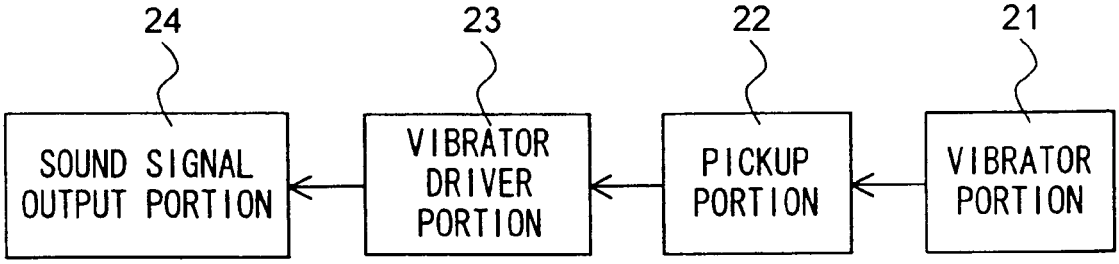
FIG. 3 is a block diagram of the card-type sound apparatus of a second embodiment of the invention.

FIG. 3 is a block diagram of the card-type sound apparatus of a second embodiment of the invention. A vibrator portion 21 vibrates according to outside sound, and a pickup portion 22 converts the vibration of the vibrator portion 21 into an electric signal. A vibrator driver portion 23 amplifies the electric signal obtained from the pickup portion 22. Here, if the output signal of the pickup portion 22 has a sufficiently high output level as an electric signal, it is not absolutely necessary to provide the vibrator driver portion 23. A sound signal output portion 24 outputs the electric signal amplified by the vibrator driver portion 23 to an external apparatus of any type.

Used as the pickup portion 22 is a piezoelectric element formed of a crystal of quartz or Rochelle salt or a thin ceramic plate. The pickup portion 22 is provided on a card-shaped substrate 1, and this card-shaped substrate 1 serves as the vibrator portion 21. Thus, as shown in the conceptual diagram of FIG. 1, sound is collected by letting the card-shaped substrate 1 itself vibrate.

Figure 4:
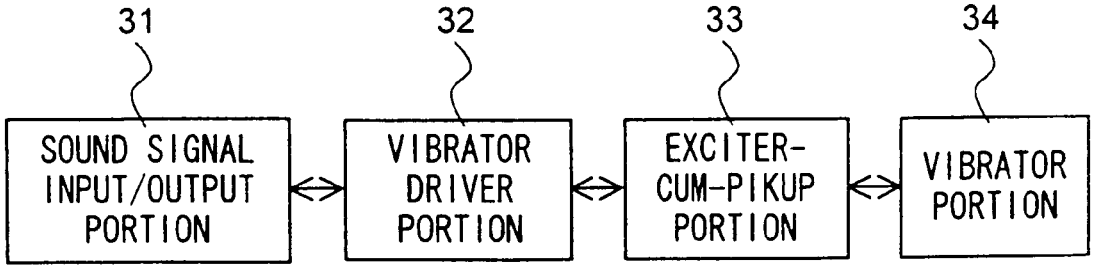
FIG. 4 is a block diagram of the card-type sound apparatus of a third embodiment of the invention.

FIG. 4 is a block diagram of the card-type sound apparatus of a third embodiment of the invention. In the third embodiment, an exciter portion is shared as a pickup portion so that the card-type sound apparatus realizes, though selectively, both loudspeaker and microphone capabilities. First, how the individual functional units operate when the card-type sound apparatus functions as a loudspeaker will be described. To a sound signal input/output portion 31, a sound signal is input from an external apparatus of any type. A vibrator driver portion 32 drives an exciter-cum-pickup portion 33 with the sound signal input to the sound signal input/output portion 31. The exciter-cum-pickup portion 33 makes a vibrator portion 34 vibrate according to the electric signal with which the exciter-cum-pickup portion 33 is driven by the vibrator driver portion 32.

Next, how the individual functional units operate when the card-type sound apparatus functions as a microphone will be described. The vibrator portion 34 vibrates according to outside sound, and the exciter-cum-pickup portion 33 converts the vibration of the vibrator portion 34 into an electric signal. The vibrator driver portion 32 amplifies the electric signal obtained from the exciter-cum-pickup portion 33. The sound signal input/output portion 31 outputs the electric signal amplified by the vibrator driver portion 32 to an external apparatus of any type.

Here, it is not absolutely necessary to provide the vibrator driver portion 32, as already described in connection with the first and second embodiments.

Used as the exciter-cum-pickup portion 33 is a piezoelectric element formed of a crystal of quartz or Rochelle salt or a thin ceramic plate. The exciter-cum-pickup portion 33 is provided on a card-shaped substrate 1, and this card-shaped substrate 1 serves as the vibrator portion 34. Thus, as shown in the conceptual diagram of FIG. 1, sound is generated and collected by letting the card-shaped substrate 1 itself vibrate.

In the third embodiment, since the vibrator portion is so structured as to function also as the pickup portion, it is easy to realize both loudspeaker and microphone functions even when a large space cannot be secured for the exciter portion or the pickup portion.

Figure 5:
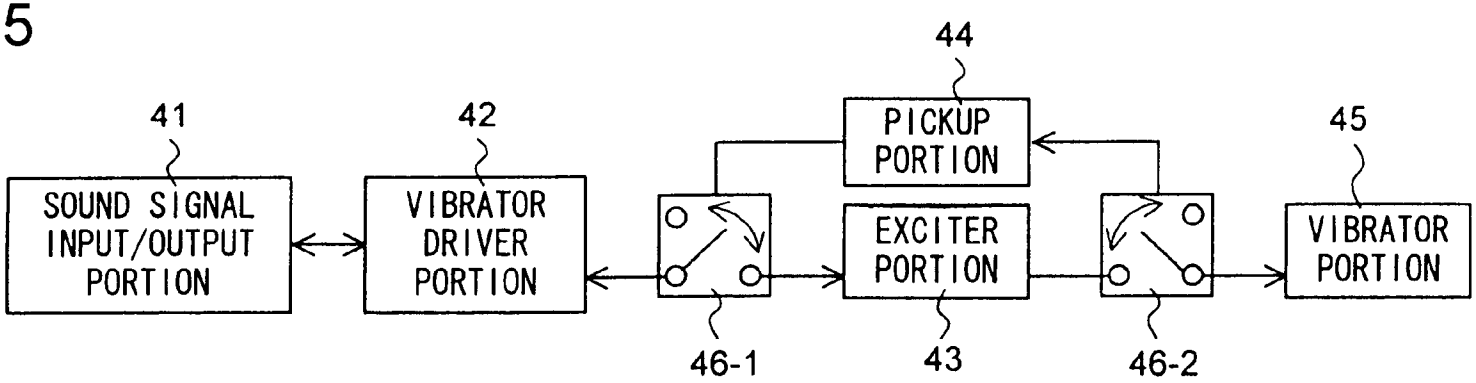
FIG. 5 is a block diagram of the card-type sound apparatus of a fourth embodiment of the invention.

FIG. 5 is a block diagram of the card-type sound apparatus of a fourth embodiment of the invention. In the fourth embodiment, an exciter portion and a pickup portion are provided separately so that the card-type sound apparatus realizes, though selectively, both loudspeaker and microphone capabilities. First, how the individual functional units operate when the card-type sound apparatus functions as a loudspeaker will be described. To a sound signal input/output portion 41, a sound signal is input from an external apparatus of any type. Switches 46-1 and 46-2 are turned to the position for an exciter portion 43, and thus a vibrator driver portion 42 drives the exciter portion 43 with the sound signal input to the sound signal input/output portion 41. The exciter portion 43 makes a vibrator portion 45 vibrate according to the electric signal with which the exciter portion 43 is driven by the vibrator driver portion 42.

Next, how the individual functional units operate when the card-type sound apparatus functions as a microphone will be described. Switches 46-1 and 46-2 are turned to the position for a pickup portion 44, and thus the pickup portion 44 converts the vibration of the vibrator portion 45, which vibrates according to outside sound, into an electric signal. The electric signal obtained from the pickup portion 44 is amplified by the vibrator driver portion 42, and is then output to an external apparatus of any type by the sound signal input/output portion 41.

Here, it is not absolutely necessary to provide the vibrator driver portion 42, as already described in connection with the first and second embodiments.

Used as each of the exciter portion 43 and the pickup portion 44 is a piezoelectric element formed of a crystal of quartz or Rochelle salt or a thin ceramic plate. The exciter portion 43 and the pickup portion 44 are provided on a card-shaped substrate 1, and this card-shaped substrate 1 serves as the vibrator portion 45. Thus, as shown in the conceptual diagram of FIG. 1, sound is generated and collected by letting the card-shaped substrate 1 itself vibrate.

As described above, in the third and fourth embodiments, loudspeaker and microphone capabilities are used alternatively. This makes it possible to achieve half-duplex communication as achieved by, for example, a transceiver.

Figure 6:
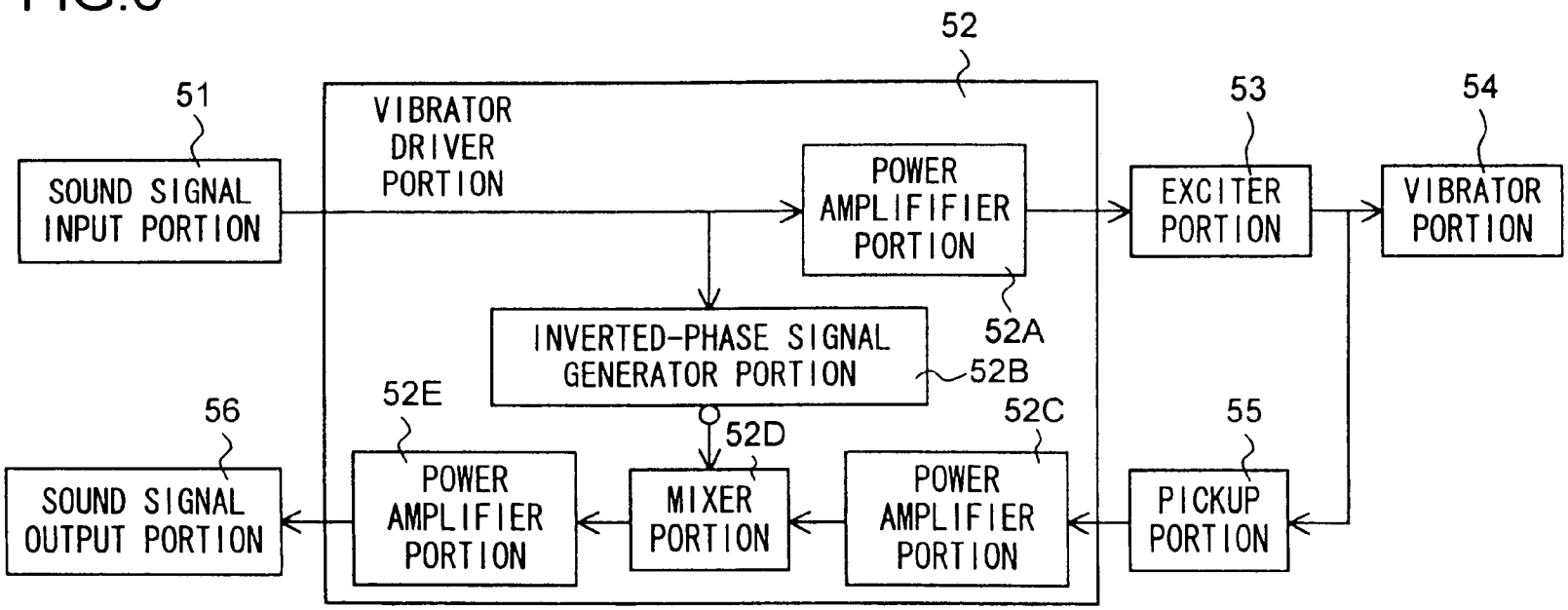
FIG. 6 is a block diagram of the card-type sound apparatus of a fifth embodiment of the invention.

FIG. 6 is a block diagram of the card-type sound apparatus of a fifth embodiment of the invention. In the fifth embodiment, an exciter portion 53 and a pickup portion 55 are provided separately so that the card-type sound apparatus realizes both loudspeaker and microphone capabilities simultaneously. A sound signal input to a sound signal input/output portion 51 is fed to a vibrator driver portion 52. In the vibrator driver portion 52, the sound signal is, on one hand, power-amplified by a power amplifier portion 52A and then fed to an exciter portion 53, and, on the other hand, fed to an inverted-signal generator portion 52B. The inverted-signal generator portion 52B inverts the phase of the sound signal input to the sound signal input/output portion 51 to produce an inverted-phase signal. The exciter portion 53 makes a vibrator portion 54 vibrate according to the electric signal fed from the power amplifier portion 52A of the vibrator driver portion 52.

A pickup portion 55 converts the vibration of the vibrator portion 54 into an electric signal. In the vibrator driver portion 52, the electric signal obtained from the pickup portion 55 is power-amplified by a power amplifier portion 52C by a previously measured fixed amplification factor in such a way that the level of the generated sound signal component is equal to that of the inverted-phase signal obtained from the inverted-signal generator portion 52B, and is then fed to a mixer portion 52D. The mixer portion 52D adds together the electric signal obtained from the pickup portion 55 and fed from the power amplifier portion 52C and the inverted-phase signal produced by the inverted-signal generator portion 52B, and outputs the sum. In this way, it is possible to eliminate, from the signal output from the pickup portion 55, the component resulting from the vibration of the vibrator portion 54 ascribable to the exciter portion 53. The signal output from the mixer portion 52D is amplified by a power amplifier portion 52E so as to have a sufficiently high output power, and is then fed to a sound signal output portion 56. The sound signal output portion 56 outputs the signal fed from the power amplifier portion 52E of the vibrator driver portion 52 to an external apparatus of any type.

As described above, in the fifth embodiment, the card-type sound apparatus collects sound while eliminating the sound that it itself generates. This makes it possible to achieve full-duplex communication as achieved by a telephone. Used as each of the exciter portion 53 and the pickup portion 55 is a piezoelectric element formed of a crystal of quartz or Rochelle salt or a thin ceramic plate. The exciter portion 53 and the pickup portion 55 are provided on a card-shaped substrate 1, and this card-shaped substrate 1 serves as the vibrator portion 54. Thus, as shown in the conceptual diagram of FIG. 1, sound is generated and collected by letting the card-shaped substrate 1 itself vibrate.

Figure 7:
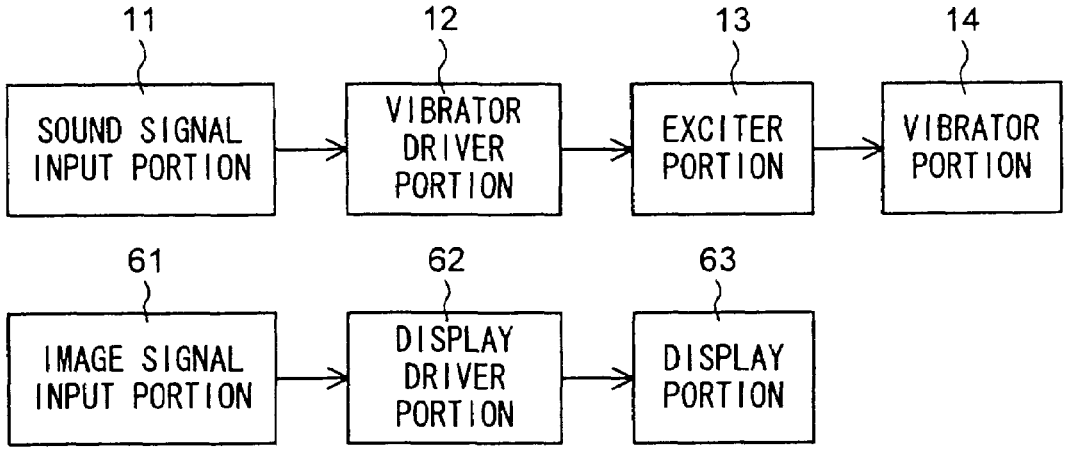
FIG. 7 is a block diagram of the card-type sound apparatus of a sixth embodiment of the invention.

FIG. 7 is a block diagram of the card-type sound apparatus of a sixth embodiment of the invention. The sixth embodiment is obtained by providing the first embodiment described earlier additionally with a display-related circuit block, which is composed of an image signal input portion 61 and a display driver portion 62, and a display portion 63. These additionally provided functional units will be described. It is to be noted that, other than the first embodiment, any of the already described embodiments shown in FIGS. 3, 4, 5, and 6 may also be further provided with an image signal input portion 61, a display driver portion 62, and a display portion 63.

To the image signal input portion 61, an image signal is input from an external apparatus of any type. The display driver portion 62 drives the display portion 63 according to the image signal input to the image signal input portion 61. As a result, images from the external apparatus are reproduced in the display portion 63. Here, a card-shaped substrate 1 as shown in FIG. 1 forms the display portion 63.

Figure 8:
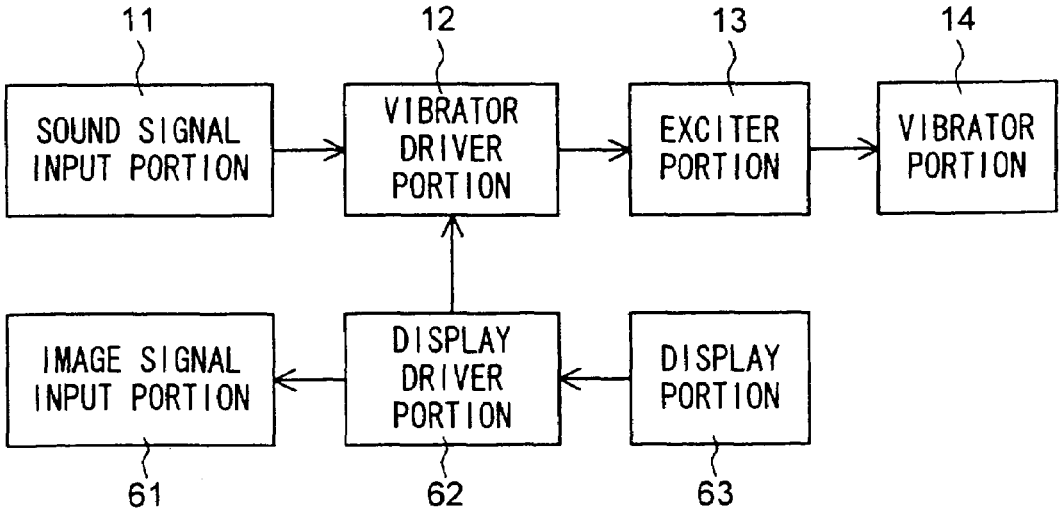
FIG. 8 is a block diagram of the card-type sound apparatus of a seventh embodiment of the invention.

FIG. 8 is a block diagram of the card-type sound apparatus of a seventh embodiment of the invention. The seventh embodiment is obtained by modifying the sixth embodiment described above in such a way that the display driver portion 62 controls the operation of the vibrator driver portion 12. The operation of the display driver portion 62 will be described with reference to a flow chart shown in FIG. 9. First, initialization is performed, and a standby state is maintained until an image signal is input (F in #101). When an image signal is input (T in #101), the display driver portion 62 feeds the vibrator driver portion 12 with a reset signal (#102). Next, the display driver portion 62 starts operating (#103), and starts display. Thereafter, when the input of the image signal is cut off (T in #104), the display driver portion 62 feeds the vibrator driver portion 12 with a mute signal (#105), and the display driver portion 62 goes into a standby state (#106).

The operation of the vibrator driver portion 12 will be described with reference to the flow chart shown in FIG. 9. First, initialization is performed, and a standby state is maintained until a reset signal from the display driver portion 62 is detected (F in #201). When a reset signal from the display driver portion 62 is detected (T in #201), the vibrator driver portion 12 starts operating (#202), and starts generating sound. Thereafter, when a mute signal from the display driver portion 62 is detected (T in #203), the vibrator driver portion 12 goes into a standby state (#204).

With the display driver portion 62 and the vibrator driver portion 23 operating as described above, in the seventh embodiment, when the display driver portion 62 is started or stopped, the vibrator driver portion 12 is started and stopped, respectively, in an interlocked manner. That is, when display is started or stopped, sound generation is started or stopped, respectively, in an interlocked manner. This eliminates the need to provide the sound-related circuit block with functions for controlling the starting and stopping thereof, and thus contributes to simplification of the circuit configuration, prevention of failure to turn off the sound-related circuit block, reduction of electric power consumption, etc.

In the example described above, the display-related circuit block controls the sound-related circuit block. It is also possible, however, to make the sound-related circuit block control the display-related circuit block so that, specifically, when sound generation is started or stopped, display is started or stopped, respectively, in an interlocked manner. In a structure realized by adding an image signal input portion 61, a display driver portion 62, and a display portion 63 to an embodiment provided with microphone capability, it is possible to likewise perform display and sound collection in an interlocked manner.

Interlocked control may be performed also in such a way that, when display is started, sound output is suppressed. This permits the card-type sound apparatus to operate in such a way that, when put away in a pocked or bag, it gives an indication with sound and, once taken out of the pocked or bag, now that the user can view the display, it automatically stops unnecessary sound.

Figure 10:
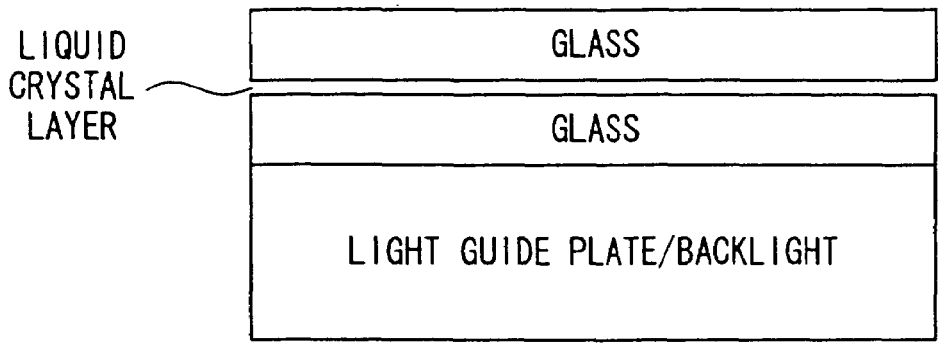
FIG. 10 is a sectional view of the display portion, when it is of a transmissive liquid crystal display type.

Here, as the display portion 63, it is possible to adopt one of the following display types. One display type achieves display by using liquid crystal. A display type using liquid crystal may be transmissive or reflective. The transmissive type, as shown in FIG. 10, which is a sectional view of a typical structure thereof, requires a backlight, and is thus disadvantageous from the viewpoint of the thickness of the card-type sound apparatus, but is excellent in color reproducibility and contrast ratio.

Figure 11:
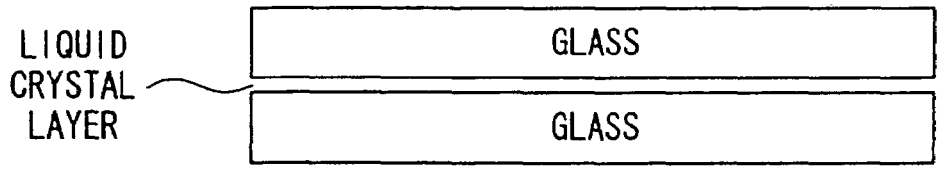
FIG. 11 is a sectional view of the display portion, when it is of a reflective liquid crystal display type.

On the other hand, the reflective type, as shown in FIG. 11, which is a sectional view of a typical structure thereof, requires only the thickness of two glass substrates, and thus helps make the card-type sound apparatus slim. Using ferroelectric liquid crystal as the liquid crystal material makes it possible to hold the displayed data, and thus helps reduce electric power consumption when still pictures are displayed.

Figure 12:
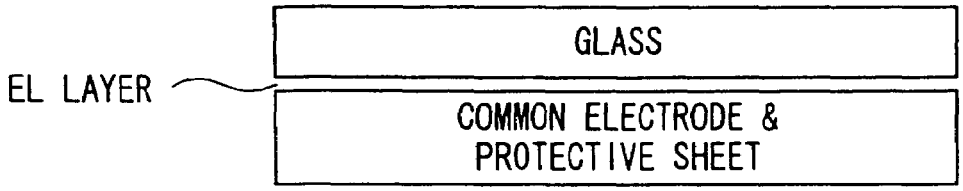
FIG. 12 is a sectional view of the display portion, when it is of a type that achieves display by using an EL device.

Another display type achieves display by using an EL (electroluminescence) device. This type, as shown in FIG. 12, which is a sectional view of a typical structure thereof, requires only one glass substrate, and thus helps make the card-type sound apparatus slimmer than by the above-described type using liquid crystal. Using a solid-phase EL device, which is resistant to sonic vibration, helps reduce the undesirable effects of vibration on display quality even when sound is generated or collected by letting the display portion itself vibrate.

Figure 13:
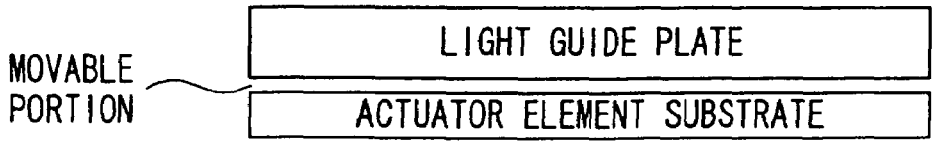
FIG. 13 is a sectional view of the display portion, when it is of a type that achieves display by controlling movable pixel portions individually with piezoelectric elements or micromachines so as to switch their states between a state in which they reflect incident light and a state in which they scatter incident light.

Still another display type achieves display by controlling movable pixel portions individually with piezoelectric elements or micromachines so as to switch their states between a state in which they reflect incident light and a state in which they scatter incident light. This type, as shown in FIG. 13, which is a sectional view of a typical structure thereof, requires substantially only the thickness of a light guide plate for controlling incident light plus a thin substrate of actuator elements, and is thus expected to make the card-type sound apparatus slimmer than by the above-described type using liquid crystal.

Figure 14:
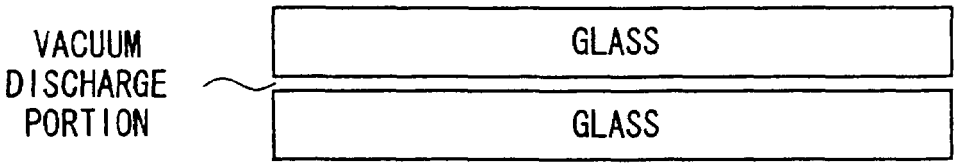
FIG. 14 is a sectional view of the display portion, when it is of an FED type.

A further display type is FED (field emission display). The FED type typically has a sectional structure as shown in FIG. 14, uses self-generated light, offers high contrast ratio and color reproducibility, and is considered to offer better display quality than obtained by the display type using an EL device. Moreover, this display type is based basically on the same principle as a cold cathode tube, and therefore it offers a longer light emission life, resulting in a far longer life time than achieved by the display type using an EL device.

Figure 15:
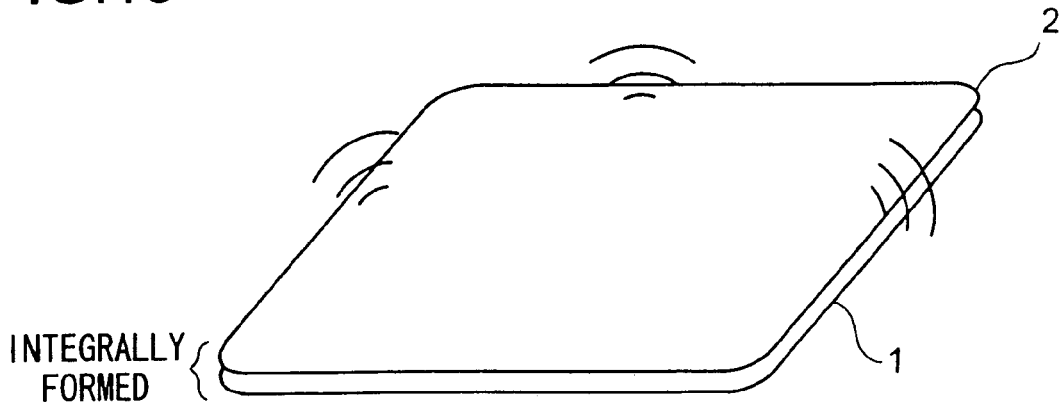
FIG. 15 is a diagram showing an example in which a card-shaped substrate forming the display portion and a transparent plate serving as the vibrator portion are bonded together.

Here, in an embodiment in which a card-shaped substrate 1 forms a display portion 63, as shown in FIG. 15, it is possible to adopt a structure in which a transparent plate 2 serving as a vibrator portion is integrally bonded to the card-shaped substrate 1 parallel to the surface thereof on which display is performed. With this structure, display, sound generation, and sound collection are performed on the same surface.

Instead, a flat plate serving as a vibrator portion may be integrally bonded to the surface of a card-shaped substrate on which no display is performed. With this structure, the vibrator portion is not located on the front surface of the display portion. This helps enhance display quality.

Figure 16:
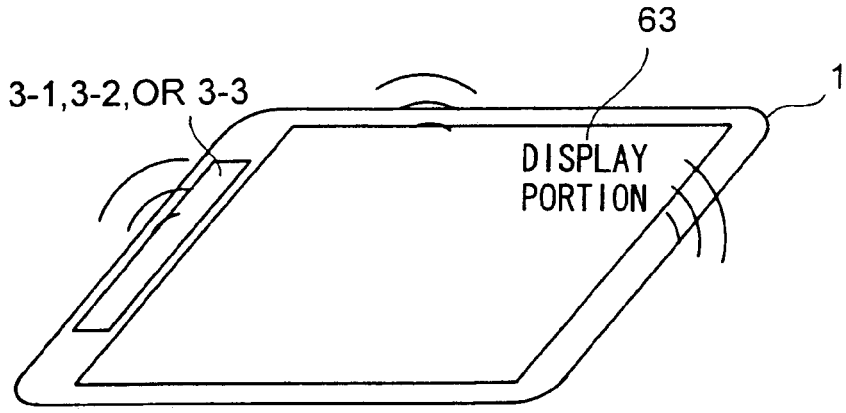
FIG. 16 is a diagram showing an example in which the exciter portion, the pickup portion, or the exciter-cum-pickup portion is provided in a frame portion of the card-shaped substrate forming the display portion in which no display is performed.
Figure 17:
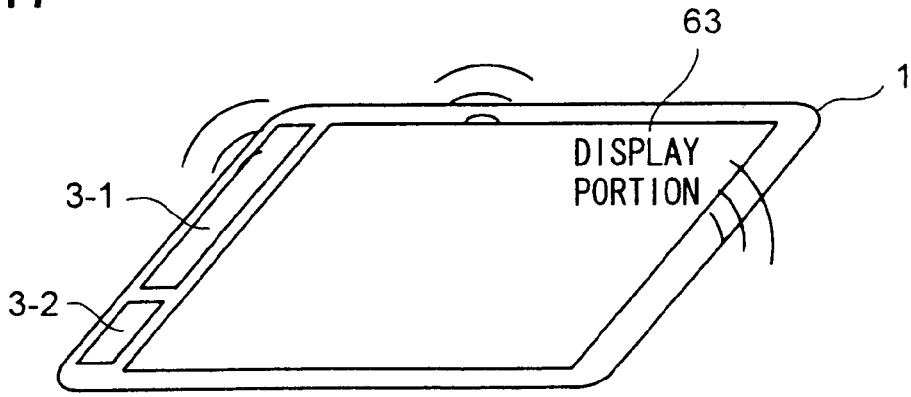
FIG. 17 is a diagram showing an example in which the exciter portion and the pickup portion are provided in a frame portion of the card-shaped substrate forming the display portion in which no display is performed.

As shown in FIGS. 16 and 17, an exciter portion 3-1, a pickup portion 3-2, or an exciter-cum-pickup portion 3-3 may be provided in a frame portion of a card-shaped substrate 1 forming a display portion 63 in which no display is performed so that the card-shaped substrate 1 itself serves as a vibrator portion. With this structure, the vibrator portion is not located on the front surface of the display portion 63. This helps obtain better display quality and make the card-type sound apparatus slimmer than with the structure shown in FIG. 15.

FIG. 16 corresponds to an embodiment in which one of an exciter portion, a pickup portion, and an exciter-cum-pickup portion is provided, and FIG. 17 corresponds to an embodiment in which both an exciter portion and a pickup portion are provided.

Figure 18:
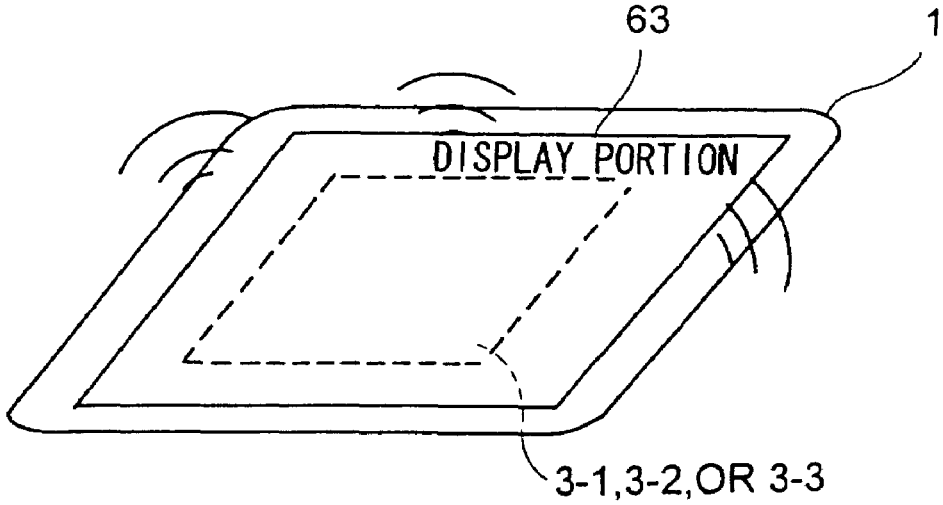
FIG. 18 is a diagram showing an example in which the exciter portion, the pickup portion, or the exciter-cum-pickup portion is provided on that surface of the card-shaped substrate forming the display portion which is not used for display.

In a case where the display portion 63 is, for example, of a reflective liquid crystal display type and is therefore of a type does not use one surface thereof, as shown in FIG. 18, an exciter portion 3-1, a pickup portion 3-2, or an exciter-cum-pickup portion 3-3 may be provided on the surface (the reverse surface in FIG. 18) of a card-shaped substrate 1 forming the display portion 63 which is not used for display. With this structure, it is possible to give the exciter portion, the pickup portion, or the exciter-cum-pickup portion 3-3 a larger area and thereby obtain a higher sound-generation or sound-collection gain without degrading display quality.

Figure 19:
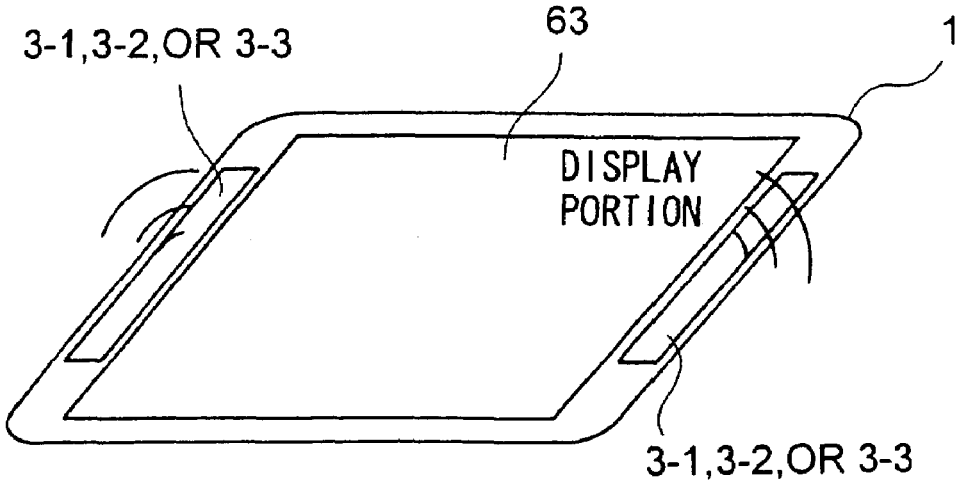
FIG. 19 is a diagram showing an example in which a plurality of exciter portions, pickup portions, or exciter-cum-pickup portions are provided.

As shown in FIG. 19, a plurality of exciter portions 3-1, pickup portions 3-2, or exciter-cum-pickup portions 3-3 may be provided. With this structure, it is possible to obtain increased sound-generation and sound-collection gains, achieve stereophonic sound reproduction, and realize directivity. Moreover, the undesirable effects of vibration on the display portion are expected to be reduced through interference inside the display portion. Thus, even if the display portion employs a movable material such as liquid crystal, the aforementioned interference inside the display portion reduces the disturbance of liquid crystal alignment, and this helps improve or maintain display quality. In FIG. 19, two exciter portions 3-1, pickup portions 3-2, or exciter-cum-pickup portions 3-3 are provided so as to face each other across the display portion 63. There are, however, no particular restrictions on where to provide them and how many of them.

Figure 20A:
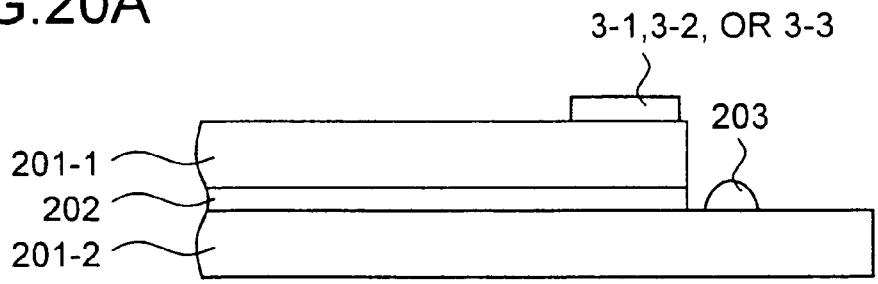
FIGS. 20A to 20C are diagrams illustrating where to provide the exciter portion, the pickup portion, or the exciter-cum-pickup portion on the display portion.
Figure 20B:
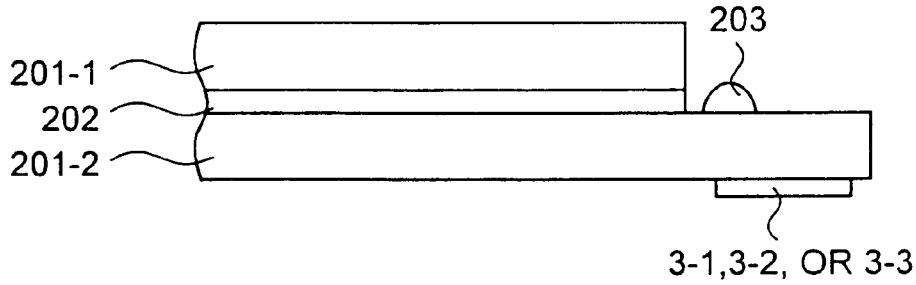
Figure 20C:
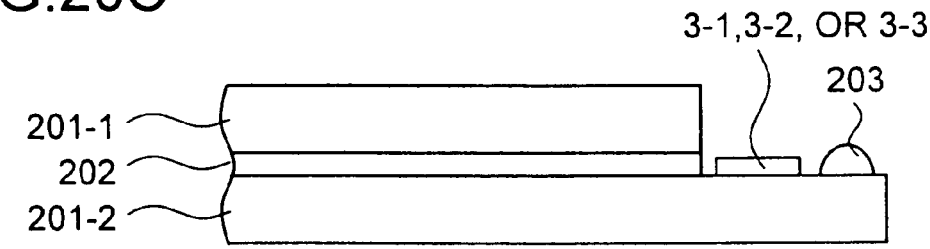

When the display portion is of a liquid crystal display type, as shown in FIG. 20, which is a sectional view thereof, a liquid crystal layer 202 is sandwiched between two substrates 201-1 and 201-2 of glass or the like. In the examples described thus far, an exciter portion 3-1, pickup portion 3-2, or exciter-cum-pickup portion 3-3 is provided on the top surface of the upper glass substrate 202-1 as shown in FIG. 20A, or on the bottom surface of the lower glass substrate 202-2 as shown in FIG. 20B. However, in a case where, as shown in FIG. 20C, one substrate 201-2 is longer than the other substrate 201-1 to provide terminals 203 of a circuit formed on a thin-film substrate of silicon or the like that is included in the liquid crystal layer 202, an exciter portion 3-1, pickup portion 3-2, or exciter-cum-pickup portion 3-3 may be provided around where the terminals 203 are provided on the substrate 201-2. By combining this structure with any of the structures shown in FIGS. 16, 17, 18, and 19, it is possible to make the card-type sound apparatus still slimmer.

Figure 21:
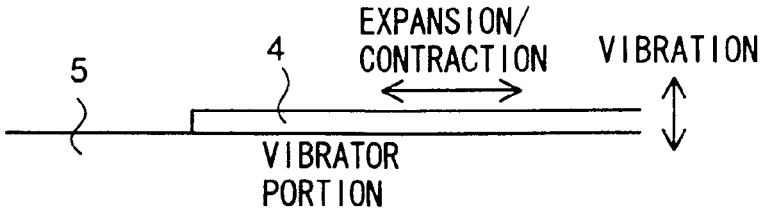
FIG. 21 is a diagram showing an example of the structure of the sound generation portion and the sound collection portion.

Here, as shown in a sectional view in FIG. 21, it is possible to adopt a structure in which an expandable plate 4 formed of ceramic or the like which forms an exciter portion, pickup portion, or exciter-cum-pickup portion is provided directly on a vibrator portion 5 (for example, a substrate of glass or the like that forms the display portion) so that sound is generated or collected by direct use of the difference in piezoelectric displacement between the expandable plate 4 and the vibrator portion 5. With this structure, it is possible to reduce the thickness of the card-type sound apparatus.

Figure 22:
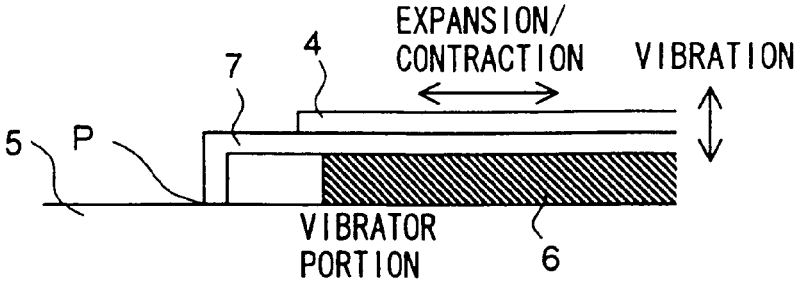
FIG. 22 is a diagram showing another example of the structure of the sound generation portion and the sound collection portion.

Alternatively, as shown in a sectional view in FIG. 22, it is possible to adopt a structure in which an expandable plate 4 is provided on a vibration transmission plate 7, such as a metal plate, that is supported partially by making direct contact with a vibrator portion 5 and partially by lying on a soft material 6, so soft as not to hamper vibration, filling the gap between the vibration transmission plate 7 and the vibrator portion 5. In this structure, the vibration energy generated by the use of the difference in displacement between the expandable plate 4 and the vibration transmission plate 7 is transmitted via a vibration energy transmission point (indicated by P in FIG. 22) to the vibrator portion 5, and thereby sound is generated. With this structure, it is possible to obtain higher sound-generation and sound-collection gains.

The portion around where the vibration transmission plate 7 makes direct contact with the vibrator portion 5 is not filled by the soft material 6, and this ensures efficient transmission of the vibration energy. From the viewpoint of enhancing the sound-generation and sound-collection gains, it is desirable to give as wide an area as possible to the light-weight portion of the vibration transmission plate 7 that does not make direct contact with the vibrator portion 5. Even when the portion of the vibration transmission plate 7 that makes direct contact with the vibrator portion 5 is made smaller to enhance the sound-generation and sound-collection gains, filling the gap between the vibration transmission plate 7 and the vibrator portion 5 with the soft material 6 helps secure satisfactory strength against external force.

Figure 9:
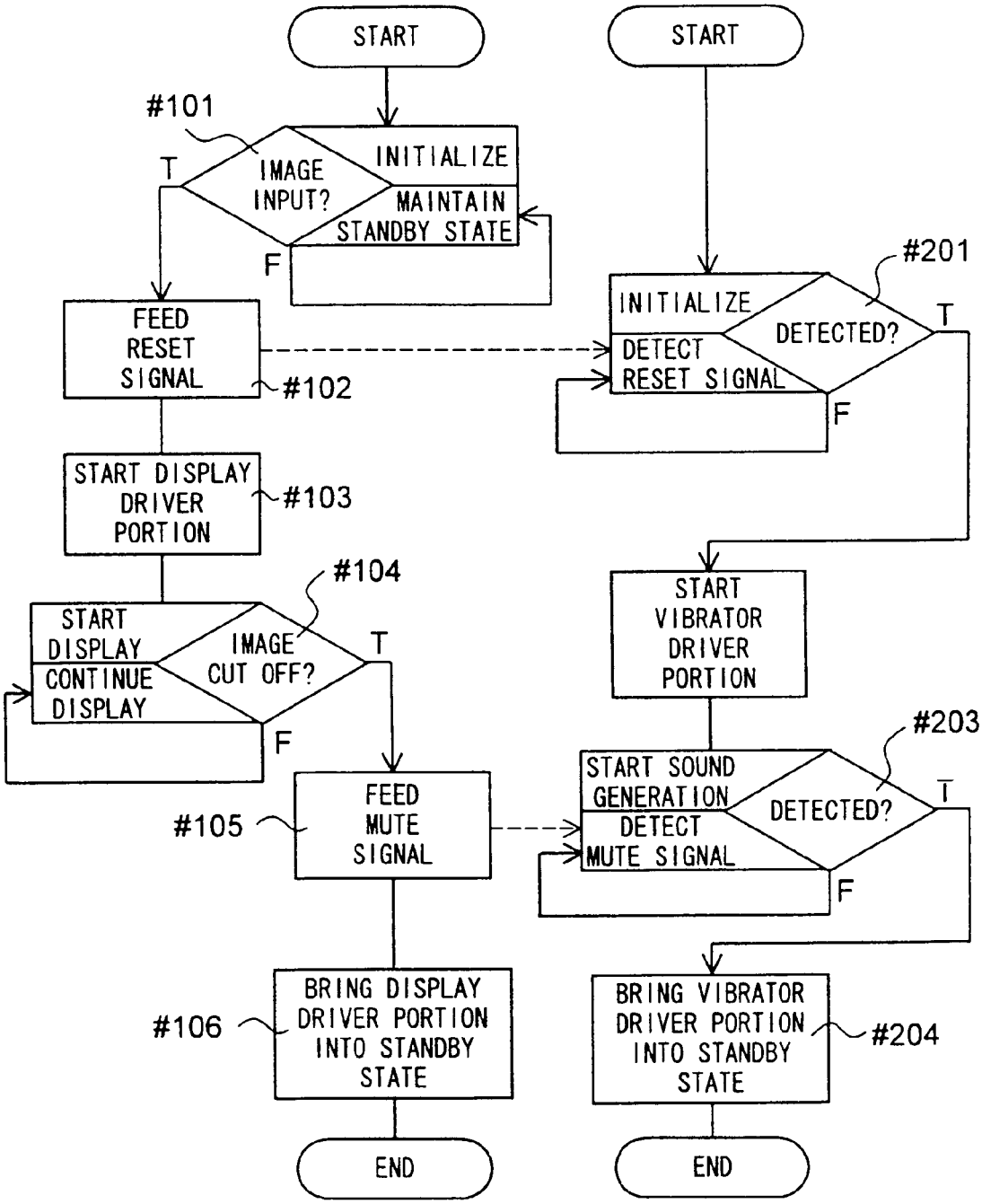
FIG. 9 is a flow chart of the operation of the display portion deriver portion and the vibrator driver portion in the seventh embodiment.
Figure 23:
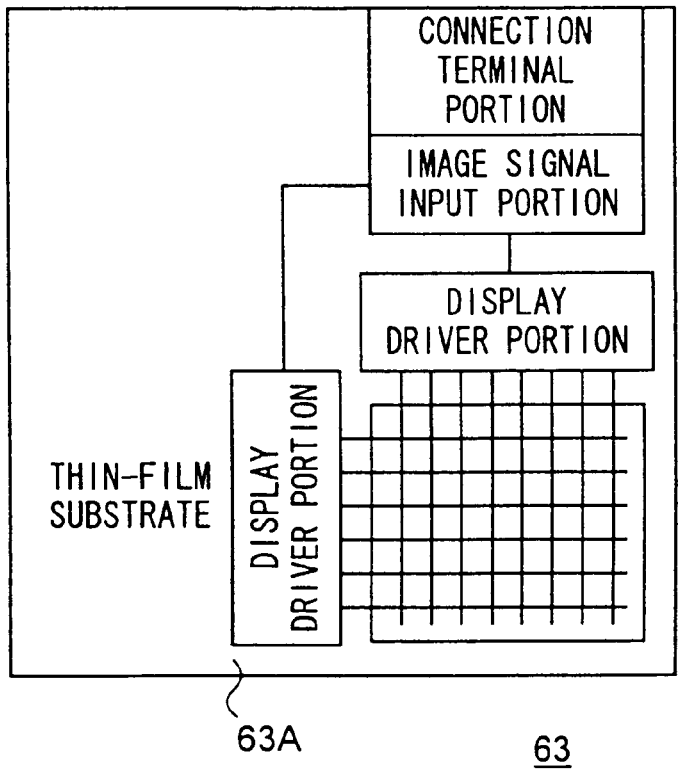
FIG. 23 is a diagram schematically showing how the display-related circuit block is formed on the thin-film substrate on which the circuit elements of the display portion are formed.

In a case where both a display-related circuit block (an image signal input portion 61 and a display driver portion 62) and a display portion 63 are provided, as schematically shown in FIG. 23, the display-related circuit block may be formed directly on a thin-film substrate 63A on which the circuit elements of the display portion 63 are formed (i.e., when the display portion 63 is of a liquid crystal display type, the substrate that is included in the liquid crystal layer shown in FIGS. 8 and 9 and on which TFTs (thin-film transistors) and the like are formed). In FIG. 23, the whole of the display-related circuit block is formed directly on the thin-film substrate 63A forming the display portion 63; it is possible, however, to form only part of the former directly on the latter.

Used as the thin-film substrate 63A is, for example, a thin film of polycrystalline silicon. Using continuous grain silicon in particular makes it possible to form a larger number of circuit elements.

Figure 24:
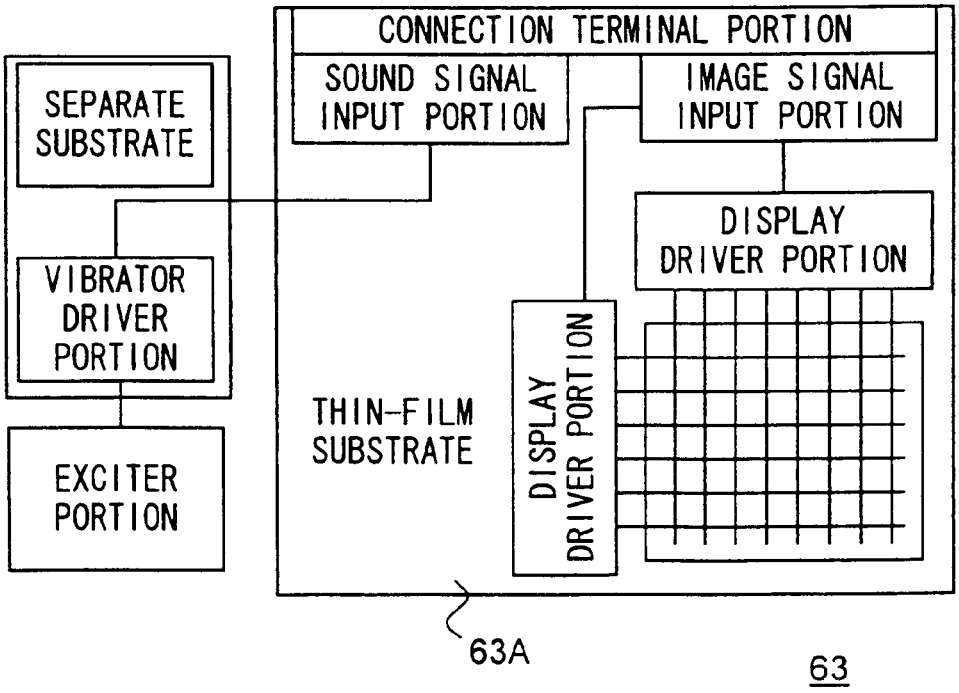
FIG. 24 is a diagram schematically showing how, in addition to the display-related circuit block, part of the sound-related circuit block that handles sound signals is formed on the thin-film substrate on which the circuit elements of the display portion are formed.
Figure 25:
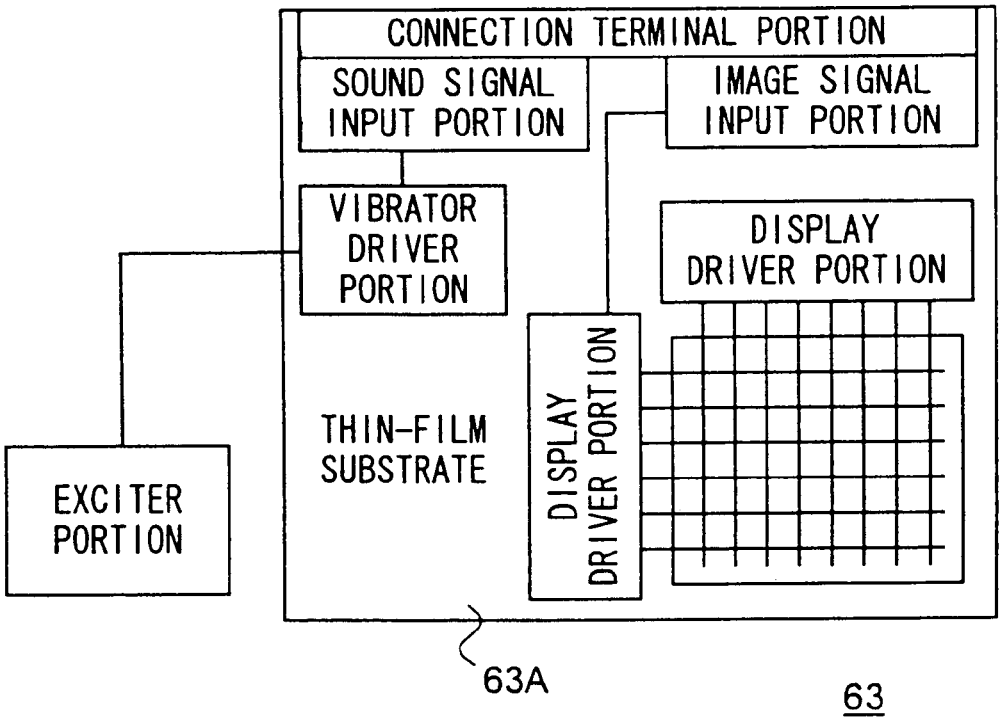
FIG. 25 is a diagram schematically showing how, in addition to the display-related circuit block, the whole of the sound-related circuit block that handles sound signals is formed on the thin-film substrate on which the circuit elements of the display portion are formed.

As schematically shown in FIGS. 24 and 25, in addition to the display-related circuit block, part or the whole of a sound-related circuit block that handles sound signals (specifically, a sound signal input portion, a sound signal output portion, a sound signal input/output portion, and a vibrator driver portion) may be formed directly on the thin-film substrate 63A on which the circuit elements of the display portion 63 are formed.

A circuit block, like the vibrator driver portion shown in FIG. 24, that is not formed directly on the thin-film substrate 63A on which the circuit elements of the display portion 63 are formed may be formed on a separate substrate, which is then mounted in a frame portion on the display portion 63, or may be formed as a bear chip, which is then mounted in a frame portion on the display portion 63.

Figure 26:
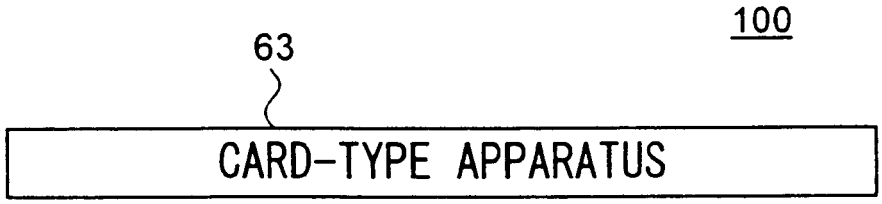
FIG. 26 is a diagram showing a card-type sound apparatus having a display portion provided on both surfaces.
Figure 27:
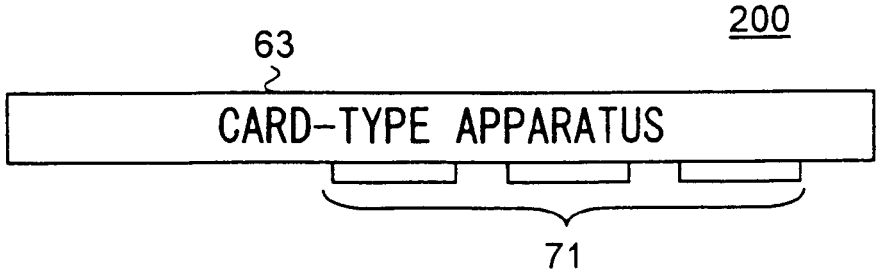
FIG. 27 is a diagram showing a card-type sound apparatus having a display portion provided on one surface and an operation portion provided on the other surface.

The embodiments described hereinbefore all deal with cases in which a display portion is provided on one surface only. It is possible, however, to produce, as shown in FIG. 26, a card-type sound apparatus 10 having display portions 63 on both surfaces as by bonding together two card-shaped substrates each forming a display portion. In this case, both surfaces may be provided with loudspeaker capability, or microphone capability, or both; only one surface may be provided with loudspeaker capability, or microphone capability, or both; the two surfaces may be provided with loudspeaker and microphone capabilities respectively; at least one surface may be provided with loudspeaker capability, or microphone capability, or both. In any of the embodiments described hereinbefore, as shown in FIG. 27, the card-type sound apparatus 20 may have a display portion 63 provided on one surface and an operation portion 71, to be operated by the user, formed on the other surface.

In any of the embodiments described hereinbefore, exchange of signals with an external apparatus may be achieved through a wired or wireless interface; the exchanged signals may be baseband signals or modulated signals.

In an electronic appliance of any type that handles images and sound, such as a television monitor, a cellular phone, a photo stand, or a character-recognition and text-reading machine, one of the card-type sound apparatuses of the embodiments described hereinbefore may be provided as a means for inputting or outputting sound or as a means for outputting images. This permits the user of such an electronic appliance to readily enjoy sound or images.

INDUSTRIAL APPLICABILITY

As described above, according to the present invention, a card-type sound apparatus is provided with loudspeaker capability, or microphone capability, or both, and thus permits its user to readily enjoy sound.

According to the present invention, a card-type sound apparatus is provided not only with loudspeaker capability, or microphone capability, or both but also with image display capability, and thus permits its user to readily enjoy sound and images. Thus, the card-type sound apparatus permits images to be enjoyed together with the sound accompanying them.

According to the present invention, by achieving sound generation or sound collection by letting a card-shaped substrate itself, which serves as the body of the card-type sound apparatus, vibrate, it is possible to make the card-type sound apparatus slim and compact easily.

According to the present invention, in a case where the card-shaped substrate forms a display portion, by arranging a vibrator portion parallel to the surface of the card-shaped substrate on which display is performed, it is possible to perform display, sound generation, and sound collection on the same surface.

According to the present invention, in a case where the card-shaped substrate forms a display portion, by providing an exciter portion or a pickup portion in a frame portion of the card-shaped substrate in which no display is performed, it is possible to enhance display quality and make the card-type sound apparatus slimmer.

According to the present invention, in a case where the card-shaped substrate that forms a display portion is of a type that does not use one surface thereof for display, by providing an exciter portion or a pickup portion on the surface of the card-shaped substrate which is not used for display, it is possible to give the exciter portion or the pickup portion a larger area and thereby obtain a higher sound-generation or sound-collection gain without degrading display quality.

According to the present invention, by providing a plurality of exciter portions and a plurality of pickup portions, it is possible to obtain increased sound-generation and sound-collection gains, achieve stereophonic sound reproduction, and realize directivity. Moreover, the undesirable effects of vibration on the display portion are reduced through interference inside the display portion, and this helps improve or maintain display quality even if the display portion employs a movable material such as liquid crystal.

According to the present invention, sharing the exciter portion as the pickup portion makes it easy to realize both loudspeaker and microphone capabilities even in a case where a sufficiently large space cannot be secured for the exciter portion or the pickup portion.

According to the present invention, in a case where both a combination of a sound signal input portion and a sound generation portion and a combination of a sound collection portion and a sound signal output portion are provided, by using those two combinations alternatively so that one of them is used at a given time, it is possible to use the card-type sound apparatus as if it is a transceiver.

According to the present invention, in a case where both a combination of a sound signal input portion and a sound generation portion and a combination of a sound collection portion and a sound signal output portion are provided, by further providing an inverted-phase signal generator portion that inverts the phase of the sound signal input to the sound signal input portion to produce an inverted-phase signal and a mixer portion that mixes the electric signal obtained from the sound collection portion with the inverted-phase signal, and feeding the signal obtained from the mixer portion to the sound signal output portion, it is possible to use the card-type sound apparatus as if it is a telephone.

According to the present invention, interlocking display operation with sound generating operation or sound collecting operation makes it unnecessary to provide functions for controlling the starting and stopping of a display-related circuit block and a sound-related circuit block separately. This helps simplify the circuit configuration, prevent failure to turn off the operation of only one of the circuit blocks, and reduce electric power consumption.

According to the present invention, by using as the exciter portion an expandable plate that expands and contracts according to an electric signal fed thereto and providing it directly on the vibrator portion, it is possible to make the card-type sound apparatus slimmer.

According to the present invention, by using as the exciter portion an expandable plate that expands and contracts according to an electric signal fed thereto in combination with a vibration transmission plate that holds the expandable plate, and supporting the vibration transmission plate partially by keeping it in direct contact with the vibrator portion and partially by laying it on a soft material, so soft as not to hamper vibration, that fills the gap between the vibration transmission plate and the vibrator portion, it is possible to obtain a higher excitation gain.

According to the present invention, by forming part or the whole of a display-related circuit block or a sound-related circuit block directly on a thin-film substrate forming a display portion, it is possible to make the card-type sound apparatus still slimmer and more compact.

The invention claimed is:

1. A card-type sound apparatus comprising:

a sound signal input portion to which a sound signal is input from outside and a sound generation portion that generates sound according to the sound signal input to the sound signal input portion, wherein the sound signal input portion and the sound generation portion are provided on a card-shaped substrate, the card-shaped substrate generating the sound as a result of the card-shaped substrate itself vibrating, the card-shaped substrate comprising a display portion, wherein the sound generation portion comprises a vibrator portion and an exciter portion that makes the vibrator portion vibrate according to the sound signal input to the sound signal input portion, and the card-shaped substrate serves as the vibrator;

wherein the exciter portion is provided in a frame portion of the card-shaped substrate in which no display is performed; and a display-related circuit block which comprises an image signal input portion to which an image signal is input from outside and a display driver portion that drives the display portion according to the image signal input to the image signal input portion, wherein part or a whole of the display-related circuit block is formed directly on a thin-film substrate on which circuit elements of the display portion are formed.

2. A card-type sound apparatus as claimed in claim 1, wherein, in addition to the part or whole of the display-related circuit block, part or a whole of a sound-related circuit block that handles a sound signal is formed directly on the thin-film substrate on which the circuit elements of the display portion are formed.

3. A card-type sound apparatus as claimed in claim 1, wherein the thin-film substrate on which the circuit elements of the display portion are formed is a thin film of polycrystalline silicon.

4. A card-type sound apparatus comprising:

a sound signal input portion to which a sound signal is input from outside and a sound generation portion that generates sound according to the sound signal input to the sound signal input portion, wherein the sound signal input portion and the sound generation portion are provided on a card-shaped substrate, the card-shaped substrate generating the sound as a result of the card-shaped substrate itself vibrating, the card-shaped substrate comprising a display portion, wherein the sound generation portion comprises a vibrator portion and an exciter portion that makes the vibrator portion vibrate according to the sound signal input to the sound signal input portion, and the card-shaped substrate serves as the vibrator;

wherein the exciter portion is provided in a frame portion of the card-shaped substrate in which no display is performed; and wherein the display portion is provided on both surfaces.

5. A card-type sound apparatus comprising:

a sound signal input portion to which a sound signal is input from outside and a sound generation portion that generates sound according to the sound signal input to the sound signal input portion, wherein the sound signal input portion and the sound generation portion are provided on a card-shaped substrate, the card-shaped substrate generating the sound as a result of the card-shaped substrate itself vibrating, the card-shaped substrate comprising a display portion, wherein the sound generation portion comprises a vibrator portion and an exciter portion that makes the vibrator portion vibrate according to the sound signal input to the sound signal input portion, and the card-shaped substrate serves as the vibrator;

wherein the exciter portion is provided in a frame portion of the card-shaped substrate in which no display is performed; and wherein the display portion achieves display by controlling states of individual movable pixel portions individually between a state in which they reflect incident light and a state in which they scatter incident light.

* * * * *